United States Patent [19]

Somborn et al.

[11] 4,209,681

[45] Jun. 24, 1980

[54] PULL SWITCH

[75] Inventors: Gunter Somborn, Hagen-Vorhalle; Johannes Kluge, Wetter; Dirk Rotthaus, Bochum; Heinz Hasselmann, Hagen; Uwe Lichtenvort, Essen, all of Fed. Rep. of Germany

[73] Assignee: DEMAG Aktiengesellschaft, Duisburg, Fed. Rep. of Germany

[21] Appl. No.: 968,084

[22] Filed: Dec. 11, 1978

[30] Foreign Application Priority Data

Dec. 16, 1977 [DE] Fed. Rep. of Germany ..... 2756103

[51] Int. Cl.[2] ..... H01H 9/06

[52] U.S. Cl. ..... 200/157; 200/298; 200/303

[58] Field of Search ..... 200/157, 298, 303

[56] References Cited

U.S. PATENT DOCUMENTS

| | | | |
|---|---|---|---|
| 2,348,107 | 5/1944 | Brongersma | 200/157 X |
| 2,390,846 | 11/1945 | Obszarny | 200/157 |
| 2,747,057 | 5/1956 | Obszarny | 200/157 |
| 2,959,656 | 11/1960 | Bentsen | 200/298 X |
| 3,086,090 | 4/1963 | Carroll | 200/298 X |
| 3,931,486 | 1/1976 | Raetz | 200/157 |

FOREIGN PATENT DOCUMENTS

| | | | |
|---|---|---|---|
| 928197 | 5/1955 | Fed. Rep. of Germany | 200/157 |
| 2603409 | 8/1976 | Fed. Rep. of Germany | 200/157 |

*Primary Examiner*—Stephen Marcus

*Attorney, Agent, or Firm*—Mandeville and Schweitzer

[57] ABSTRACT

A suspended pull or control switch is provided for overhead mechanical devices, such as power hoists, in which the control switch is so suspended and configured to be physiologically oriented with respect to the attendant's position that the attendant may grasp and visually consult the switch over a long period of time without becoming as fatigued as is the case with conventionally positioned switches. This is achieved by configuring the body of the switch, or at least that portion grasped, to be angled from the vertical axis of suspension of the switch to that degree necessary for the handle portion to be ergonomically work-oriented with the attendant's hand and angle of vision. A dual control switch may be utilized in which both hands of the attendant would be conformed to.

12 Claims, 8 Drawing Figures

PULL SWITCH

BACKGROUND AND DESCRIPTION OF THE INVENTION

The invention refers to a pull switch with switch operating keys or bars which can be reached by means of a handle. This type of pull switch is used to control hoisting gears and is provided over the entire length with push buttons, according to German Pat. No. 1,135,986, or with a handle at the lower end and a sliding feeler or key above, according to German Pat. No. 2,024,109. Usually the pull switches are suspended from support lines which are attached at the pull switch in the center axis. Thus, the pull switches hang vertically, which is unfavorable with respect to handling and thus leads to fatigue, being that the fingers of an informally opened hand are positioned askew to the lower arm, not at a right angle. For favorable handling, the pull switches are usually suspended at elbow height. However, this height is disadvantageous for reading symbols which are coordinated with the operating keys, and for reading any indicators possibly arranged on the switch, since the viewing angle towards this surface is not a right angle. If the latter is desired for correct reading, the pull switch must be kept in an oblique position.

It is, therefore, the object of the invention to provide a pull switch in a manner that is suitable for easy operation, as well as for correct reading. This is done by tilting the handle in an ergonomically or physiologically work-oriented fashion with the lower end extending toward the attendant from a vertical plane by preferably about 20°. This is the angle of fingers of a relaxed hand if the lower arm is held horizontally. The viewing angle toward the switch is then at right angles, too. In this position, it is possible to maintain and keep under surveillance, a switch, without fatigue over a longer period of time.

In order to achieve the desired slanted position, the pull switch hangs from at least one support line which is connected to the inclined pull switch above the center of gravity of the latter. Preferably, two support lines are connected to a top cap of the pull switch on that side which faces towards the attendant (front), and the electric lines are connected to the rear part of the cap. The support lines may be provided with length adjusting devices to facilitate adjustment of the slanted position considering the share of the weight of the electric lines. The support lines comprise a hose-like element with reinforced threads.

For pull switches whose entire length is provided with switch operating keys, the casing has a front and rear casing plate with lateral parts facing one another. The entire pull switch forms the handle in this case. The parting joint between front and rear casing plate runs along the front half of the pull switch. This arrangement of the parting joint has the advantage that the switch inserts are then free on the sides to install and connect the electric lines. The lateral faces of the larger rear casing plate are slanted so that the rear portion of the pull switch is more narrow than the front portion to form a gripping surface. This is also the shape of a semi-opened hand, so that the hand may maintain this position without fatigue over a longer period of time.

The pull switch casing may be provided with ridges following the front and rear faces along the lateral walls, such ridges protruding in the front and in the back. When holding the pull switch, the fingertips reach behind the rear ridges and the ball of the thumb lies across the front ridge, which allows secure handling of the pull switch.

Furthermore, the front casing plate may embrace the entire cross section of the pull switch on top and may be covered by a screw-on cap, which is configured to allow the support lines and the electric lines to extend through to the interior. The support lines are each attached to the pull switch by means of a pin. This pin goes through the joint between the cap and the front part of the casing, the latter being provided with an indentation on top for receiving the support lines.

As the pull switch is to be small and handy, there is logically only a small gap provided for the electric lines between the internal switch parts and the casing. In order to simplify assembly, the pull switch extends on both sides of the internal switch parts and is provided with retaining extensions for the electric lines. These retaining extensions are provided with tips directed towards the switch insert part and approaching the latter so closely that it is just barely possible to slip an electric line between the tip of the extension and the switch insert.

The front of the pull switch casing may be provided with an indicator panel, which may be illuminated. The indicator panel shows the switched-on state of the hoisting gear or the amount of the load. It is also possible to connect two pull switch casings via one common cap. In this case, the front faces are preferably inclined toward one another and form an angle of about 140°, which is also the angle formed by thumbs if semi-opened hands are held together so that the thumbs touch at the tips.

Two examples of the invention are shown in the drawings, and explained as follows.

DETAILED DESCRIPTION OF THE INVENTION

Figure 1:
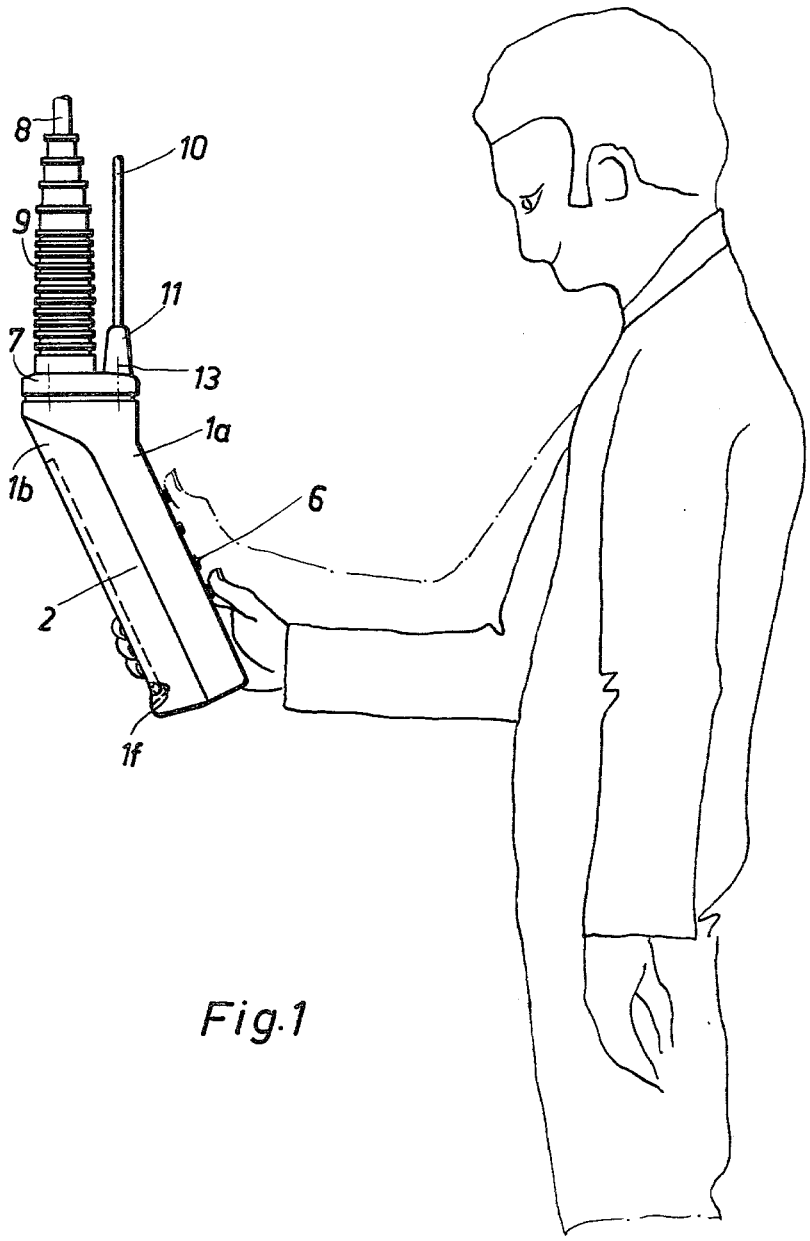
FIG. 1 is a side elevational view of a control switch of the invention, illustrating the manner in which it is held.
Figure 6:
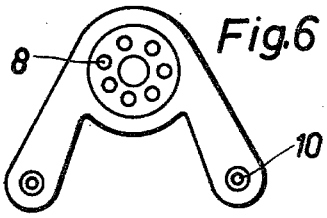
FIG. 6 is a cross sectional view along lines VI—VI of FIG. 2.
Figure 3:
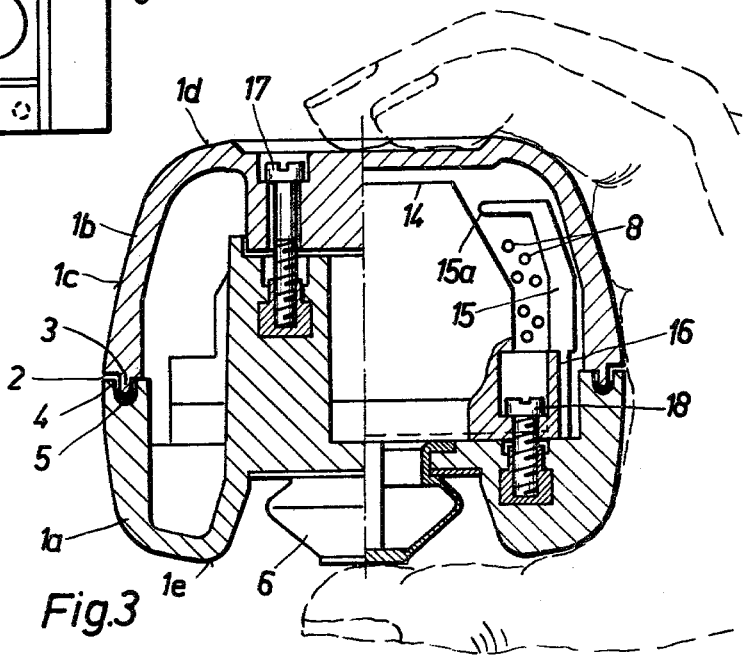
FIG. 3 is an enlarged cross sectional view taken along lines III—III of FIG. 2.

FIG. 1 shows the pull switch which is inclined by about 20°, with the lower switch operating key 6 at a height of 1.2 m and suspended from support lines 10. As FIG. 6 shows, two support lines 10 are in spaced positions and arranged in a triangle with electric lines 8 extending through a cable socket 9 and cap 7 screwed onto the front portion 1a of the pull switch casing by means of screws 13, leading to switch inserts or internal parts 14 as shown in FIG. 3. The pull switch casing is provided with a front casing plate 1a and a rear casing plate 1*b*, which are connected with one another at a joint 2. The front casing plate 1a just below the cap 7, extends over the entire width of the pull switch, and is covered by cap 7.

Figure 2:
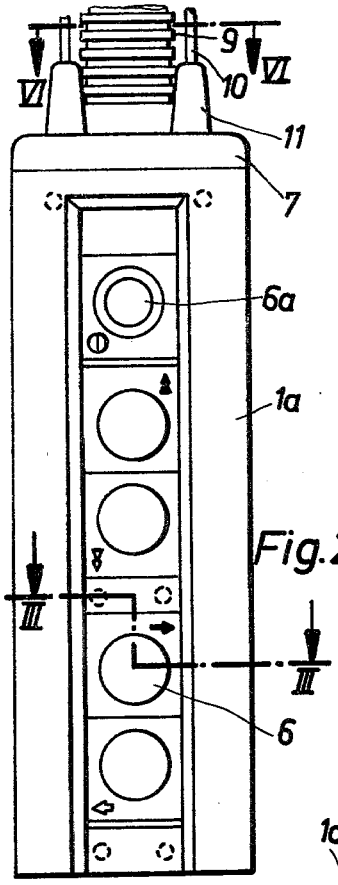
FIG. 2 is an enlarged front elevational view of the control switch of FIG. 1.

FIG. 2 shows the switch operating keys 6 in superimposition within the front casing part 1*a*, and the shutoff key 6*a* which, when locked, prevents any unauthorized start-up of the hoisting gear.

FIG. 3 shows the front casing plate 1*a* and the rear casing plate 1*b*, with the pronounced angle of lateral faces 1*c*, as well as rear finger ridge 1*d* and the front thumb ridge 1*e*. The hand indicated in broken lines shows how pleasant the grip on the pull switch is, and one is easily convinced by imitating the position of the hand.

The rear casing plate 1*b* has in the lower portion in the rear finger ridge 1*d*, an indentation 1*f* for the pinkie, as shown in FIG. 1. Switch operating keys 6 for the switch inserts 14 are arranged between thumb ridges 1*e*. Along the separating joints between switch inserts or parts 14, retaining digits or extensions 15 are arranged in grooves 16 for lines 8. The retaining digits 15 are provided with angled tips 15*a*, which come very close to slanted switch inserts 14. The joint 2 between the front casing plate 1*a* and the rear casing plate 1*b* lies in the area of the front portion of switch inserts 14 and is formed by a ridge 3 and a groove 4, with an imbedded seal 5. The course of the joint can be seen in FIG. 1. The casing plates 1*a* and 1*b* are connected by means of screws 17. The switch parts or inserts 14 are attached to the front casing plate 1*a* by means of screws 18.

Figure 4:
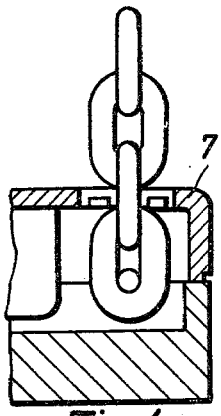
FIGS. 4 and 5 are detailed views of two embodiments of support lines and connections for the control switch of the invention.
Figure 5:
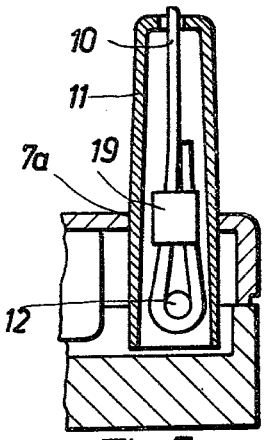

FIG. 4 shows a chain as the support line 10, and according to FIG. 5 the support line 10 consists of a cable. In both cases, the support line goes through an opening 7*a* in cap 7, and is fastened in the pull switch by means of a pin 12. A cap 11 may be inserted into opening 7*a* as protection for the cable clamp 19, when using a cable.

Figure 7:
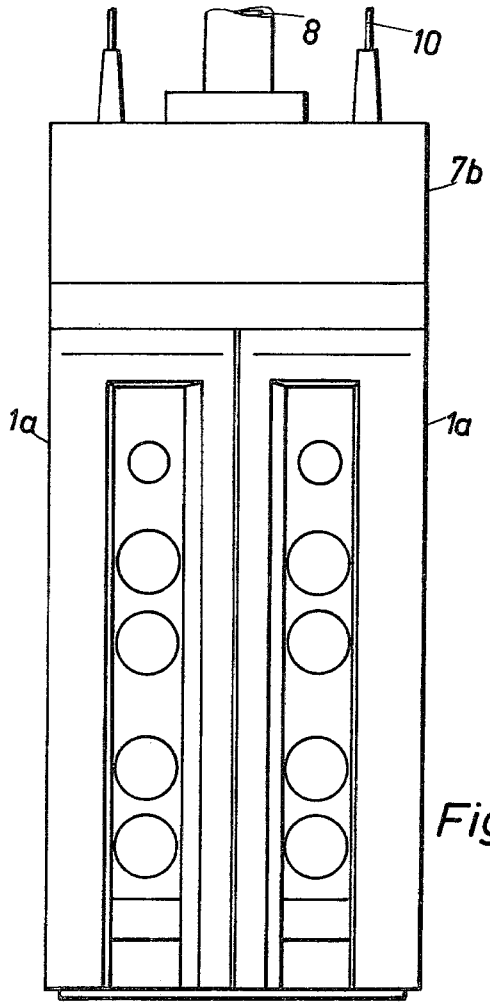
FIG. 7 is a front elevational view of a further embodiment of the invention, in which dual control switches are illustrated.
Figure 8:
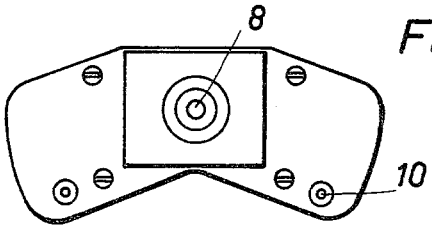
FIG. 8 is a top plan view of the dual arrangement in FIG. 7.

According to FIGS. 7 and 8, two pull switch casings are connected to one common cap 7*b*, and thus are connected to one another. The front casing plates 1*a* form an angle of about 140° as shown in FIG. 8. Both pull switches are connected to lines 8 and are jointly suspended from traction elements 10.

We claim:

1. A pull switch for operating a hoist or the like, said pull switch suspended from said hoist, comprising
(a) a switch body;
(b) a plurality of switch operating keys on the front side of said body; the improved characterized by
(c) said switch body being the handle for said pull switch;
(d) whereby all said switch operating keys are within reach of the thumb when grasping said body;
(e) said switch body suspended from at least one support line;
(f) the connection of said support line being above the center of gravity of said switch body;
(g) said entire body being angled from the vertical axis of said support line; and
(h) said angle being ergonomically favorable for an attendant grasping said handle.

2. The apparatus of claim 1, further characterized by
(a) said angle being about 20 degrees.

3. The apparatus of claim 1, further characterized by
(a) a top cap on said body;
(b) two support lines connected to said top cap;
(c) the said support line connections to said cap being spaced from each other on the side thereof facing the front of said body; and
(d) electric lines extending through said cap on the side thereof facing the rear of said body.

4. The apparatus of claim 3, further characterized by
(a) a length adjusting device on said support lines.

5. The apparatus of claim 3, further characterized by said body including
(a) a front casing half;
(b) a rear casing half; and
(c) said front and rear halves including cooperating joined side walls.

6. The apparatus of claim 5, further characterized by
(a) the side walls of said rear casing half being longer than the side walls of said front casing half; and
(b) said side walls of said rear casing half being tapered toward the rear, starting from the juncture with said front casing half.

7. The apparatus of claim 5, further characterized by said cooperating joined side walls including
(a) a continuous ridge on said rear casing half; and
(b) a continuous groove on said front casing half for receiving said ridge.

8. The apparatus of claim 3, further characterized by
(a) a support pin fixed in said body for each support line; and
(b) each said support line extending through said cap and engaging its respective support pin.

9. The apparatus of claim 3, further characterized by
(a) a plurality of spaced switch parts disposed in said body and connected to said electric lines;
(b) a plurality of spaced projections in said body for supporting said parts and maintaining each said part and associated electric lines positioned; and
(c) tips on each said spaced projections for maintaining said parts and lines segregated.

10. A pull switch for operating a hoist or the like, said pull switch suspended from said hoist, comprising
(a) a switch body;
(b) a switch handle forming part of said body;
(c) switch operating keys on said handle; the improvement characterized by
(d) said handle angled from the vertical axis of said body;
(e) said angle being ergonomically favorable for an attendant grasping said handle;
(f) a top cap on said body;
(g) two support lines connected to said top cap;
(h) the said support line connections to said cap being spaced from each other on the side thereof facing the front of said body;
(i) electric lines extending through said cap on the side thereof facing the rear of said body;
(j) said body including a front casing half and a rear casing half;
(k) said front and rear halves including cooperating joined side walls;
(l) the top of said body is integral with said front casing half; and
(m) said top cap is connected to the top of said front casing half.

11. A pull switch for operating a hoist or the like, said pull switch suspended from said hoist, comprising
(a) a switch body;
(b) a switch handle forming part of said body;
(c) switch operating keys on said handle; the improvement characterized by (d) said handle angled from the vertical axis of said body;

(e) said angle being ergonomically favorable for an attendant grasping said handle;

(f) two opposed joined switch bodies;

(g) a top cap on said joined switch bodies;

(h) two support lines connected to said joined switch bodies;

(i) said support lines being spaced from each other with one each connected to one of said switch bodies; and (j) electric lines connected through said cap.

12. The apparatus of claim 11, further characterized by (a) the front faces of said joined switch bodies are positioned at an angle of 140 degrees to each other.

* * * * *